US010262470B2

(12) United States Patent
Buchholz et al.

(10) Patent No.: US 10,262,470 B2
(45) Date of Patent: Apr. 16, 2019

(54) GEOGRAPHICALLY LOCATING MALFUNCTION SOURCES FOR MOTOR VEHICLES

(71) Applicant: Audi AG, Ingolstadt (DE)

(72) Inventors: Jan Buchholz, Ergolding (DE); Sebastian Engel, Ingolstadt (DE); Björn Hohlstein, Ingolstadt (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 15/568,724

(22) PCT Filed: May 14, 2016

(86) PCT No.: PCT/EP2016/000800
§ 371 (c)(1),
(2) Date: Oct. 23, 2017

(87) PCT Pub. No.: WO2016/188615
PCT Pub. Date: Dec. 1, 2016

(65) Prior Publication Data

US 2018/0165890 A1 Jun. 14, 2018

(30) Foreign Application Priority Data

May 22, 2015 (DE) ..... 10 2015 006 676

(51) Int. Cl.
*G07C 5/00* (2006.01)
*G08G 1/01* (2006.01)
(Continued)

(52) U.S. Cl.
CPC ..... *G07C 5/008* (2013.01); *G07C 5/0808* (2013.01); *G08G 1/0112* (2013.01);
(Continued)

(58) Field of Classification Search
CPC ..... G07G 5/008; G08G 1/0112
See application file for complete search history.

(56) References Cited

U.S. PATENT DOCUMENTS 9,047,722 B2 * 6/2015 Kurnik ..... G07C 5/0808
9,514,581 B2 * 12/2016 Rood ..... G07C 5/0808
(Continued)

FOREIGN PATENT DOCUMENTS

CN 101240734 A 8/2008
CN 101434221 A 5/2009
(Continued)

OTHER PUBLICATIONS

English-language abstract of German Patent Application Publication No. 10 2013 200 731 A1, published Jul. 24, 2014; 1 page.
(Continued)

*Primary Examiner* — Alex C Dunn
(74) *Attorney, Agent, or Firm* — Sterne, Kessler, Goldstein & Fox, P.L.L.C.

(57) ABSTRACT

The invention relates to a method for geographically localizing triggers for malfunctions in a motor vehicle, wherein the malfunction of the motor vehicle is detected and an error entry describing the malfunction in an error memory of the motor vehicle is generated, and a geo-position (XY) of the motor vehicle is detected and stored by a localization device of the motor vehicle pp(1). Subsequently, during an error diagnosis of the motor vehicle, the error entry from the error memory of the motor vehicle is read out by an analysis device located outside the motor vehicle and a trigger class (14) describing a trigger of the malfunction is received for the error entry. The geo-position (XY) of the motor vehicle and the malfunction are stored in a corresponding digital map for the trigger class.

14 Claims, 1 Drawing Sheet

(51) Int. Cl.
*G08G 1/0967* (2006.01)
*G07C 5/08* (2006.01)

(52) U.S. Cl.
CPC ..... *G08G 1/0129* (2013.01); *G08G 1/0141* (2013.01); *G08G 1/096716* (2013.01); *G08G 1/096741* (2013.01); *G08G 1/096775* (2013.01)

(56) References Cited

U.S. PATENT DOCUMENTS

| | | | | |
|---|---|---|---|---|
| 9,697,503 | B1 * | 7/2017 | Penilla | G06Q 10/20 |
| 9,818,088 | B2 * | 11/2017 | Penilla | G06Q 10/1095 |
| 9,928,488 | B2 * | 3/2018 | Penilla | G06Q 10/1095 |
| 9,940,142 | B2 * | 4/2018 | Maria | H04L 67/12 |
| 2011/0034183 | A1 * | 2/2011 | Haag | G06Q 50/26 455/456.3 |
| 2015/0100199 | A1 * | 4/2015 | Kurnik | G07C 5/0808 701/32.4 |
| 2015/0187088 | A1 * | 7/2015 | Iwai | G06K 9/00771 345/634 |
| 2016/0115702 | A1 * | 4/2016 | Nordbruch | G05D 1/0055 701/23 |
| 2016/0142472 | A1 * | 5/2016 | Imamura | H04L 45/7453 709/205 |
| 2016/0217627 | A1 * | 7/2016 | Khalaschi | G07C 5/0808 |
| 2017/0270490 | A1 * | 9/2017 | Penilla | G06Q 10/1095 |
| 2018/0025328 | A1 * | 1/2018 | Penilla | G06Q 10/1095 705/305 |
| 2018/0089912 | A1 * | 3/2018 | Penilla | G06Q 10/1095 |

FOREIGN PATENT DOCUMENTS

| | | | |
|---|---|---|---|
| CN | 103273878 | A | 9/2013 |
| DE | 102004050597 | A1 | 4/2006 |
| DE | 102009053753 | A1 | 5/2011 |
| DE | 102010051040 | A1 | 6/2011 |
| DE | 102012025364 | A1 | 7/2014 |
| DE | 102013200731 | A1 | 7/2014 |
| DE | 102013015704 | A1 | 3/2015 |
| DE | 102014114084 | A1 | 4/2015 |

OTHER PUBLICATIONS

English-language abstract of German Patent Application Publication No. 10 2012 025 364 A1, published Jul. 3, 2014; 2 pages.
English-language abstract of German Patent Application Publication No. 10 2004 050 597 A1, published Jul. 3, 2014; 2 pages.
English-language abstract of German Patent Application Publication No. 10 2013 015 704 A1, published Mar. 26, 2015; 2 pages.
English-language abstract of Gelman Patent Application Publication No. 10 2010 051 040 A1, published Jun. 16, 2011; 1 page.
English-language abstract of German Patent Application Publication No. 10 2009 053 753 A1, published May 26, 2011; 2 pages.
International Search Report and Written Opinion of the International Searching Authority directed to related International Patent Application No. PCT/EP2016/000800, dated Sep. 2, 2016, with attached English-language translation; 26 pages.
International Preliminary Report on Patentability directed to related International Patnt Application No. PCT/EP2016/000800, dated May 22, 2017, with attached English-language translation; 14 pages.

* cited by examiner

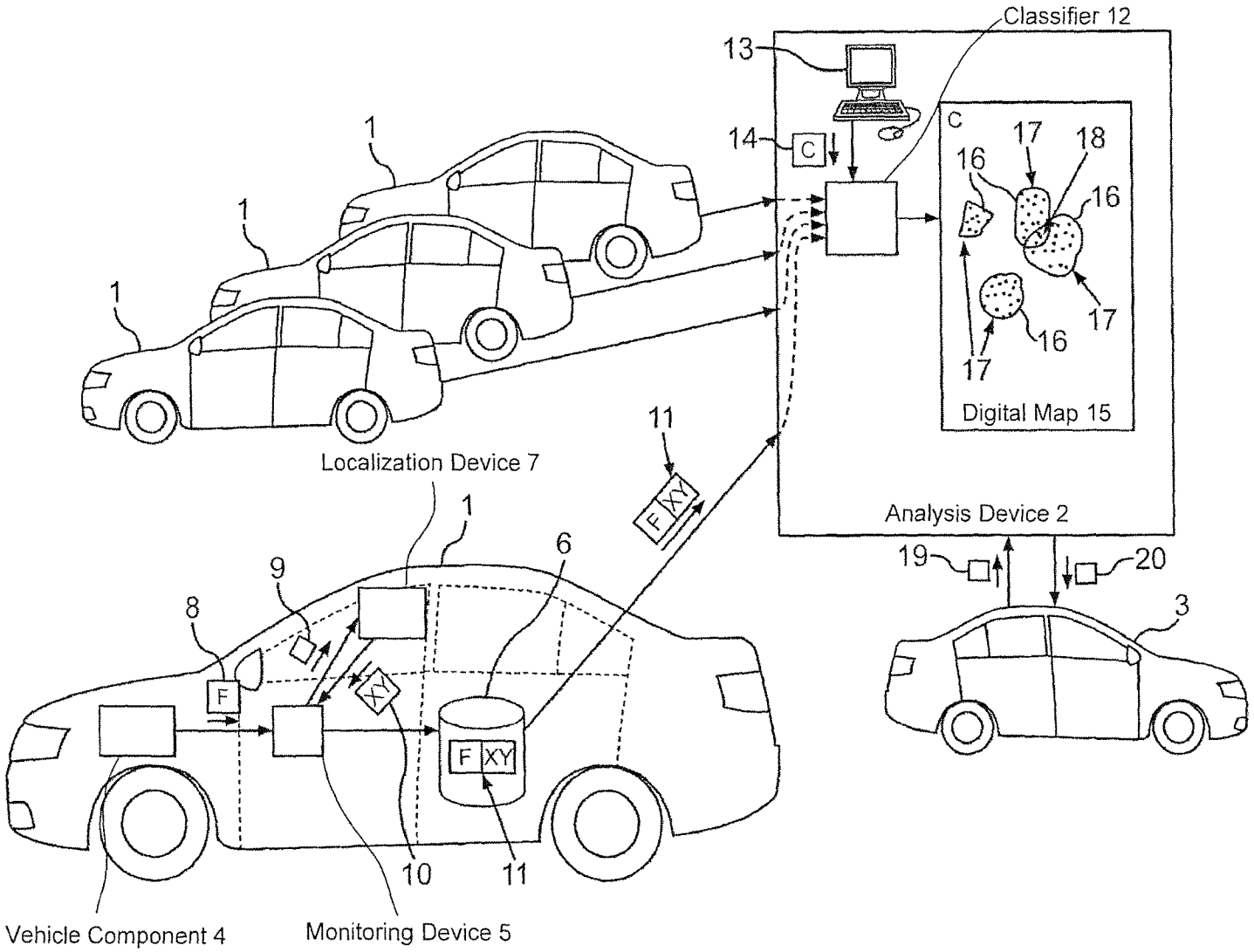
Classifier 12
Digital Map 15
Analysis Device 2
Localization Device 7
Monitoring Device 5
Vehicle Component 4
1
3
6
8
9
10
11
13
14
15
16
17
18
19
20
C
F
XY

GEOGRAPHICALLY LOCATING MALFUNCTION SOURCES FOR MOTOR VEHICLES

TECHNICAL FIELD

The invention relates to a method for geographically locating triggers for malfunctions in motor vehicles. In particular, the geographical locations at which martens damage motor vehicles are determined. The invention is a further development of a method according to DE 10 2013 200 731 A1.

BACKGROUND

According to the method known from the prior art, the location and the current time are received by a target vehicle and a search is carried out in a database for at least one entry of a previously occurring instance of damage to another motor vehicle at the particular location and/or its surrounding area. The risk to the target vehicle is then estimated based on the determined location and time, and an indication of the risk is output in the target vehicle when the estimated value exceeds a threshold value. In order to create the database, findings from accident research, police accident maps, geographically recorded own-vehicle damage and liability claims of the insurance industry and data from the accident research of automobile clubs and vehicle manufacturers are used.

In connection with the geographical location of triggers for malfunctions in motor vehicles which damage the motor vehicle during a parking phase, the following problem has been observed. Damage to a motor vehicle caused by a marten or by frost or extensive solar radiation generally does not lead to the motor vehicle becoming undrivable. On the contrary, the driver uses the motor vehicle after the parking phase and notices during the ride that a monitoring device of the motor vehicle, e.g., its on-board diagnostic device, indicates a malfunction of the motor vehicle. For example, a warning light can be activated. The driver will then visit a repair shop at the next opportunity and have the malfunction investigated. If it is then determined in the repair shop that it is a malfunction which must have occurred during a parking phase, such as, for example, a marten bite or a burst line due to frost, the driver can generally not reconstruct where the motor vehicle was when it was damaged because he cannot remember where he parked the car during the last few days. This makes it difficult to create an accurate database as required in the prior art.

In connection with warning a driver of a target vehicle about a hazard arising from wild animals crossing, a wild animal crossing warning device is known from DE 10 2004 050 597 A1, which can be provided in a motor vehicle and detects wild animals by means of a sensor system. Furthermore, means are provided which are designed for determining a hazard potential for a wild animal crossing based on the results of the sensor systems and on further supplied data.

DE 10 2012 025 364 A1 discloses a method for generating a warning concerning a wild animal crossing for a motor vehicle. In this method, a processing unit determines data relating to the movement of the motor vehicle and from a database retrieves data regarding a wild animal crossing relating to the movement of the motor vehicle. From this, a risk for the motor vehicle from a wild animal crossing is determined.

BRIEF DESCRIPTION OF THE FIGURE

The FIGURE shows a schematic representation of an analysis device and a plurality of motor vehicles according to an embodiment of the motor vehicle according to the invention, wherein an embodiment of the method according to the invention is performed by the analysis device and the motor vehicles.

DETAILED DESCRIPTION

The invention is based on the object of reliably geographically localizing triggers for malfunctions in a motor vehicle.

The task is achieved by the objects of the independent claims. Advantageous developments of the invention arise from the features of the dependent claims.

The invention comprises a method for geographically localizing triggers for malfunctions in motor vehicles. Such a trigger can be, for example, a marten or a frost-hazard parking space or a parking space with intensive sun exposure. The method uses a plurality of motor vehicles as sources of information. In each of the motor vehicles, a malfunction of the motor vehicle is detected by the corresponding monitoring device of the motor vehicle. Such a monitoring device is available in motor vehicles from the prior art, for example, as so-called on-board diagnostics. A malfunction can, for example, be engine damage or an insufficient fluid pressure, for example, of oil or coolant. An error entry which describes the malfunction is generated in an error memory. The error memory can be an error memory known per se from the prior art for the error diagnostics facility of a motor vehicle.

According to the invention, a geo-position of the motor vehicle is additionally determined and stored by a localization device of the motor vehicle. The localization device can, for example, receive a signal from a GNSS (Global Navigation Satellite System) and determine the geo-position therefrom. An example of a GNSS is the GPS (Global Positioning System). An error entry is thus stored for each malfunction in the motor vehicles, and a geo-position of the motor vehicle is stored in each motor vehicle. Later, in the case of an error diagnosis of the motor vehicles, for example, in a repair shop to which the particular motor vehicle has been brought, the error entries are read out from the error memories of the motor vehicles. This is carried out by means of an off-board analysis device, which can be connected, for example, to the motor vehicles via readout devices. For each error entry, a trigger class describing the respective trigger of the malfunction is received. In other words, the reason for each malfunction is determined. For example, the trigger class may indicate that the malfunction was caused by a marten bite or by frost damage or by heat damage. A corresponding digital map can be provided for each trigger class (marten bite, frost damage, heat damage). The method provides for storing the geo-position of the motor vehicles with malfunctions of the same trigger class in the associated digital map for the trigger class. In other words, the locations of all those vehicles are mapped where a malfunction has been detected or has occurred due to the same trigger class (for example, marten bite).

The invention provides the advantage that a digital map is generated for at least one trigger class, in that, in the event of a malfunction, the geo-position of the motor vehicle is additionally provided, by means of which the trigger of the malfunction can be localized.

The invention also includes optional developments, the features of which result in additional advantages.

According to one development, said geo-position is determined during the detection of the malfunction. In other words, the geographical location of the position of the motor vehicle is determined where the motor vehicle was present while the malfunction was detected. As a result, triggers which cause the malfunction can be mapped while the motor vehicle is driving. These can be, for example, potholes through which the motor vehicle drives and is thereby damaged. An additional further development provides for the geo-position being detected and stored during a parking phase of the motor vehicle. In other words, where the motor vehicle was last parked is stored. This results in the advantage that a geo-position is also correctly determined even if damage to the motor vehicle was caused by the trigger, for example, a marten bite, resulting in or exhibiting the malfunction only subsequently, during the driving operation of the motor vehicle. This can happen, for example, when an operating fluid is leaking from the motor vehicle and the malfunction is detected only after a predefined amount of fluid loss.

According to one development, the geo-position is stored in the error entry by the monitoring device. In other words, the error function and the geo-position are stored together as an error entry in the error memory. This results in the advantage that the geo-position of the motor vehicle is provided universally for all error entries of the motor vehicle. In this way, a manufacturer of the motor vehicle can deduce construction-related and/or inherent weaknesses or susceptibilities of a vehicle model of the motor vehicle by recognizing and detecting the same malfunctions in motor vehicles of similar geographical locations, for example, on gravel roads or in cold regions.

According to one development, the detection of the malfunction is carried out during an engine start of the motor vehicle and/or during an activation of the ignition of the motor vehicle. This results in the advantage that the malfunction can be reliably associated with the preceding parking process. In other words, a change in the motor vehicle, as a result of the malfunction, is unambiguously recognized as related to the parking phase. According to one development, the detection of the malfunction is only performed after the parking phase when the parking phase had a predetermined minimum duration. The parking phase is characterized by a switched-off drive engine of the motor vehicle. In other words, the ignition of the motor vehicle is switched off during the parking phase. Taking into account a minimum duration results in the advantage that short intermediate stops, during which damage to a motor vehicle by a trigger, such as, for example, a marten or frost, is unlikely, are not detected erroneously as the geo-position of a trigger.

As already described, the malfunction must still be assigned to one trigger class in order to reliably assign to the same trigger a plurality of different malfunctions which can be caused by the same trigger. For example, a marten can damage a plurality of different components in the engine compartment of a motor vehicle whose defectiveness, in turn, can result in different malfunctions. By assigning a trigger class to the malfunctions, the different malfunctions are assigned to one and the same trigger class, for example, marten bite. According to one development, the trigger class is received via a manual input device from an operator of the analysis device. In other words, an operator, for example a mechanic in a repair shop, is provided with the option of entering a detected cause of error as a trigger class into the analysis device. The analysis device can, for example, be connected to input devices in several repair shops. The analysis device can thus comprise a central computing device, which is connected to the input devices and/or the diagnostic devices already described. In the central computing device, the geo-positions can also be input into a digital map. Providing a manual input device results in the advantage that even error sources which are not automatically classifiable can be evaluated. For example, traces of the bites of a marten cannot be detected automatically or only with disproportionate technical effort.

The motor vehicles described so far represent information sources for localizing the triggers.

According to one development, the digital map with the geo-positions of the triggers is then used for warning a driver of a vehicle. Such a vehicle, which is not an information source but a vehicle using the analysis device, is referred to as a target vehicle.

According to one development, an intention to park is detected in the target vehicle and a presence of a trigger of at least one trigger class is detected in the digital map of a geo-position of an anticipated parking space for the target vehicle. In other words, a check is carried out as to whether the target vehicle intends to park in a parking space at or near which a trigger has been observed. For example, a check can be made as to whether martens have been observed in the vicinity of the parking space. If the trigger is present, a notification is output in the target vehicle. The driver of the target vehicle can then decide for himself whether he wants to take the risk or whether he prefers to look for another parking space. A detection device, which is described in DE 10 2013 015 704 A1, can be used for recognizing the parking intention.

As already stated, one preferred trigger class represents a marten bite. Such a marten bite is caused by a marten as a trigger. The digital map for marten bites thus shows or contains geo-positions of such motor vehicles in which a malfunction has occurred due to a marten bite. Determining the territorial boundaries results in the advantage that a notification of a risk of a marten bite can be provided for a geographical area, even if no marten bite has been observed so far in this area.

According to one development, the trigger class "marten bite" is used to determine a territorial boundary of a marten territory of at least one marten, doing so on the basis of a cluster analysis in the digital map. The marten territory is then marked as an area in which a trigger is present. Clusters of geo-positions which can be assigned to one and the same animal are thus determined by means of a cluster analysis. A suitable cluster analysis can be carried out, for example, using the k-means algorithm. In general, algorithms from the field of "data mining" can be used to determine territorial boundaries.

In addition or as an alternative to the cluster analysis, behavioral data regarding martens can be used as the basis for the determination of the territorial boundary. By means of the behavioral data, it is possible, for example, to specify the territorial area sizes which martens prefer. Furthermore, for example, a territorial behavior of a marten can be described which indicates the spatial and/or temporal movement patterns of a marten within its territory. Taking behavioral data into consideration results in the advantage that the territorial boundaries are particularly plausible, since they take into account the natural behavior and abilities of martens.

According to one development, an overlap area of two overlapping marten territories is identified in the digital map. The overlap area is then marked as an area in which a risk of a marten bite is greater than in an overlap-free marten territory. This results in the advantage that the natural behavior of martens is taken into account which in overlapping territorial areas tend to be particularly active in causing damage to motor vehicles. It is suspected that marten bites serve a territorial markings.

The invention also includes a motor vehicle which has particularly advantageous features by means of which the described geographical localization of triggers for malfunctions in motor vehicles can be carried out. In a manner known per se, the motor vehicle has a monitoring device for detecting a malfunction of the motor vehicle and an error memory for storing an error entry describing the malfunction. Furthermore, in a manner known per se, a localization device is provided for detecting a geo-position of the motor vehicle, i.e., for example, a GPS sensor. In the motor vehicle according to the invention, the monitoring device is additionally designed to generate a request signal upon detection of the malfunction. Furthermore, as a function of the request signal, the localization device is designed to provide a current geo-position of the motor vehicle and/or a geo-position taken up by the motor vehicle during a last parking phase. The advantage of the motor vehicle according to the invention is that, when a malfunction is detected, this malfunction can also be assigned to a geographical location, namely the current geo-position of the motor vehicle and/or the geo-position last occupied during a parking phase. This enables the mapping of error events in the described manner. By means of the additional classification of malfunctions in trigger classes provided according to the method, damage sources or triggers for the malfunctions can then be mapped in a digital map.

The motor vehicle according to the invention is preferably takes the form of a car, in particular as a passenger car.

By means of the described analysis device and a plurality of motor vehicles, which each represent an embodiment of the motor vehicle according to the invention, a localization system is formed as a whole, which is also to be regarded as a constituent part of the invention.

In the following, an exemplary embodiment of the invention is described. In this regard, the sole FIGURE shows a schematic representation of an analysis device and a plurality of motor vehicles according to an embodiment of the motor vehicle according to the invention, wherein an embodiment of the method according to the invention is performed by the analysis device and the motor vehicles.

The exemplary embodiment described below is a preferred embodiment of the invention. In the exemplary embodiment, the described components of the embodiment respectively represent single features of the invention, which features are to be considered independently of each other and are respectively further developed independently of each other by the invention and which features are thus also to be considered individually or in a combination other than the one shown as a component of the invention. Additionally, the described embodiment is also expandable by additional, already described features of the invention.

The FIGURE shows a plurality of motor vehicles 1, each of which represents an embodiment of the motor vehicle according to the invention. An analysis device 2 and a target vehicle 3 are also shown.

In the following only a single motor vehicle 1 is described, the other motor vehicles 1 can be designed in the same way. The motor vehicle 1 may have a vehicle component 4, which can be, for example, a cooling circuit or a drive motor. Furthermore, the motor vehicle 1 has a monitoring device 5, an error memory 6 and a localization device 7. The localization device 7 can, for example, have a sensor for a GNSS, for example a GPS. The monitoring device 5 can, for example, be provided by one or more sensors and/or a control device. The control device can, for example, receive via a communication bus, for example a CAN bus (Controller Area Network) error data 8 from other control devices of the motor vehicle 1, which have detected the malfunction F during self-diagnostics.

In the illustrated example, it is assumed that the vehicle component 4 is defective, e.g., has a malfunction. The cause of this is a marten bite which has damaged the vehicle component 4.

The monitoring device 5 can determine the malfunction data 8 for the malfunction F. For example, it is possible to monitor whether a fluid pressure of a cooling system is within a setpoint range. In the event of a deviation of the pressure value from the setpoint range, the malfunction F is deduced, e.g., the error data 8 is generated. When the malfunction F is detected, a request signal 9 is transmitted to the localization device 7 by the monitoring device 5.

As a function of the request signal 9, the localization device 7 generates geo-position data 10 which indicate a geo-position or coordinates XY of the motor vehicle 1 as determined by the localization device 7. These may be actual coordinates of the motor vehicle 1 or the coordinates of a parking space where the motor vehicle 1 was last parked. For this purpose, the localization device 7 can have a memory which is updated whenever the motor vehicle 1 is parked again.

From the error data 8 and the geo-positioning data 10 the monitoring device 5 generates an error entry 11, which is stored in the error memory 6. Each error entry 11 thus indicates the malfunction F and the geo-position XY. The error memory 6 can be an error memory known per se from the prior art for storing error data which are collected via a communication bus in the motor vehicle 1.

In the example, it is assumed that a driver of the motor vehicle 1 notices the malfunction F. For example, a warning signal (not shown) can also be generated in the motor vehicle 1 by the monitoring device 5, which alerts the driver to the malfunction F. The driver may have brought the motor vehicle 1 to a repair shop because of the malfunction F. For example, in the repair shop, the error memory 6 of each motor vehicle 1 can be read out by the analysis device 2, i.e. the error entries 11 are transmitted to the analysis device 2.

For this purpose, the analysis device 2 can be connected to read-out devices, which can be provided in many repair shops. The analysis device 2 may have a central computing device in which the error entries 11 of all the motor vehicles 1 are collected. The analysis device 2 may, for example, have a classifier 12 in the computing device, which assigns a trigger class 14 to each malfunction F. This assignment may, for example, be carried out by an operator for whom the analysis device 2 can be connected to one or a plurality of input devices 13. The input devices 13 may, for example, be provided in the repair shops.

In the example, it is also assumed that an operator recognizes that the malfunction F of the motor vehicles 1 has in each case been triggered by a trigger class 14, which in the example represents a marten bite C. The analysis device 2 can also have a digital map 15 into which the geo-positions XY stored in the error entries 11 can be input. In this case, the digital map 15 is provided for a trigger class, for example, the trigger class "marten bite" C. All of the geo-positions XY which are assigned to a marten bite are thus mapped or recorded in the digital map 15.

By means of the analysis device, it is also possible to determine additional territorial boundaries 16, which in each case demarcate a marten territory 17. In addition, overlap areas 18 can be determined, which result from an overlapping of two marten territories 17. The determination of the territorial boundaries 16 can be based on behavioral data of martens.

In the example, a driver of the target vehicle 3 is looking for a parking space. A geo-position 19 of the parking space can, for example, be known on the basis of an input navigation destination and/or a driver's habit of the driver of the target vehicle 3, such as may be stored in a driver profile, or on the basis of an analysis such as can be determined from the mentioned document.

The geo-position 19 of the prospective parking space of the target vehicle 3 can be transmitted to the analysis device 2. This can be done, for example, via a radio link and/or through the internet. Based on the digital map 15, the analysis device 2 can be used to determine whether the geo-position 19 is located in a marten area. For this purpose, it is not necessary for a marten bite to have already occurred at the geo-position 19 itself. The marten territory 17 indicates the potential area of action of a marten. If the geo-position 19 is located in a marten territory 17, a notification 20 can be generated by the analysis device 2, which can be transmitted to the target vehicle 3. The notification 20 can then be output to the driver in the target vehicle 3. For example, a visual notification or a voice output for delivering the notification 20 may be provided.

By way of example, the following principle of the invention is illustrated. If the malfunctioning of a vehicle is recognized in a repair shop as being the result of a marten bite, a database will provide the information as to where the driver parked the vehicle on the night before. Since martens are nocturnal, this parking space is the most likely geo-position at which the damage occurred. For this purpose, the GPS position of the motor vehicle is preferably used. If the evaluation of the database reveals that damage from marten bites has cumulatively occurred in an area, for example, in a public parking lot, this area is characterized as a "hazard area" for marten damage.

If a driver of a networked vehicle, e.g., a target vehicle, intends parking his vehicle overnight in a hazard area, he will be informed that the area is known for damage caused by marten bites. The intention to park can be detected by recognition of the parking process itself, by a comparison with a navigation destination and/or by checking the time of day. In a particularly advantageous embodiment of this idea, not only the position of reported marten damage is filed in the database, but also a comparison is made with regard to territorial behavior and/or territory sizes of martens so that overlap areas are classified as particularly hazardous.

Through this idea, hazardous and particularly hazardous areas for damage caused by marten bites are identified by means of swarm data. This information is provided to drivers before they park overnight.

Overall, the example shows how the invention can provide swarm data for the avoidance of damage caused by martens.

The invention claimed is:

1. A method for geographically localizing triggers for malfunctions in a motor vehicle, the method comprising:

detecting, using a sensor of the motor vehicle, a malfunction of the motor vehicle in response to the motor vehicle being in a parking phase;

determining, using a localization device of the motor vehicle, a geo-position (XY) of the motor vehicle based on the detecting the malfunction of the motor vehicle;

generating an error entry comprising the malfunction of the motor vehicle and the geo-position (XY) of the motor vehicle;

storing the error entry in an error memory of the motor vehicle;

reading out the error entry from the error memory of the motor vehicle by an analysis device located outside the motor vehicle;

receiving a trigger class describing a trigger of the malfunction of the motor vehicle based on the error entry;

storing the geo-position (XY) of the motor vehicle with the malfunction of the motor vehicle in a digital map associated with the trigger class; and detecting a presence of a second trigger of the trigger class for an anticipated parking space for the motor vehicle based on the digital map.

2. The method according to claim 1, wherein the detecting the malfunction of the motor vehicle is performed after the motor vehicle has been in the parking phase a predetermined minimum duration.

3. The method according to claim 1, wherein the trigger class is received by an operator of the analysis device via an input device.

4. The method according to claim 1, wherein a parking intention is detected in the motor vehicle, and the presence of the second trigger of the trigger class is detected at a geo-position of the anticipated parking space in the digital map, and a notification is transmitted to the motor vehicle when the second trigger is present at the geo-position of the anticipated parking space.

5. The method according to claim 1, wherein the trigger class is a marten bite caused by a marten as the trigger of the malfunction of the motor vehicle.

6. The method according to claim 5, wherein on a basis of a cluster analysis or behavioral data of martens in the digital map for the trigger class, a territorial boundary of a marten territory of the marten is determined, and the marten territory is marked as an area in which the trigger of the malfunction of the motor vehicle is present.

7. The method according to claim 6, wherein an overlap area of two overlapping marten territories is determined in the digital map, and the overlap area is marked as an area in which a risk of a marten bite is greater than in an overlap-free marten territory.

8. A motor vehicle comprising:

a sensor configured to:

detect a malfunction of the motor vehicle in response to the motor vehicle being in a parking phase;

generate an error entry comprising the malfunction of the motor vehicle and a geo-position (XY) of the motor vehicle; and store the error entry in an error memory of the motor vehicle;

a localization device configured to:

determine the geo-position (XY) of the motor vehicle based on the detecting the malfunction of the motor vehicle; and an analysis device configured to:

receive a trigger class describing a trigger of the malfunction of the motor vehicle based on the error entry;

store the geo-position (XY) of the motor vehicle with the malfunction of the motor vehicle in a digital map associated with the trigger class; and detect a presence of a second trigger of the trigger class for an anticipated parking space for the motor vehicle based on the digital map.

9. The motor vehicle according to claim 8, wherein the localization device is further configured to provide the geo-position (XY) of the motor vehicle in response to a request signal from the sensor.

10. The motor vehicle according to claim 8, wherein the sensor is further configured to detect the malfunction of the motor vehicle after the motor vehicle has been in the parking phase a predetermined minimum duration.

11. The motor vehicle according to claim 8, wherein the trigger class is a marten bite caused by a marten as the trigger of the malfunction of the motor vehicle.

12. The motor vehicle according to claim 8, wherein a parking intention is detected in the motor vehicle, and the presence of the second trigger of the trigger class is detected at a geo-position of the anticipated parking space in the digital map, and a notification is transmitted to the motor vehicle when the second trigger is present at the geo-position of the anticipated parking space.

13. The motor vehicle according to claim 8, wherein on a basis of a cluster analysis or behavioral data of martens in the digital map for the trigger class, a territorial boundary of a marten territory of the marten is determined, and the marten territory is marked as an area in which the trigger of the malfunction of the motor vehicle is present.

14. The motor vehicle according to claim 13, wherein an overlap area of two overlapping marten territories is determined in the digital map, and the overlap area is marked as an area in which a risk of a marten bite is greater than in an overlap-free marten territory.

* * * * *